US010750889B2

(12) United States Patent
Bishop

(10) Patent No.: US 10,750,889 B2
(45) Date of Patent: Aug. 25, 2020

(54) QUILT BATTING MATERIALS AND METHODS OF USING THE SAME

(71) Applicant: Birdie Bird LLC, Weatherby Lake, MO (US)

(72) Inventor: Jean Bishop, Weatherby Lake, MO (US)

(73) Assignee: Birdie Bird LLC, Weatherby Lake, MO (US)

( * ) Notice: Subject to any disclaimer, the term of this patent is extended or adjusted under 35 U.S.C. 154(b) by 199 days.

(21) Appl. No.: 15/714,641

(22) Filed: Sep. 25, 2017

(65) Prior Publication Data

US 2019/0090666 A1 Mar. 28, 2019

(51) Int. Cl.
*A47G 9/02* (2006.01)
*D05B 11/00* (2006.01)

(52) U.S. Cl.
CPC ..... *A47G 9/0261* (2013.01); *A47G 9/0207* (2013.01); *D05B 11/00* (2013.01); *A47G 9/02* (2013.01); *A47G 9/023* (2013.01); *A47G 9/0238* (2013.01); *A47G 9/0284* (2013.01)

(58) Field of Classification Search
CPC ..... A47G 9/02; A47G 9/0207; A47G 9/0238; A47G 9/0284; A47G 9/0223; A47G 9/023; A47G 9/0261; D05B 11/00
See application file for complete search history.

(56) References Cited

U.S. PATENT DOCUMENTS 365,625 A * 6/1887 Palmer ..... A47G 9/0207 5/502
1,355,177 A * 10/1920 Sollen ..... D03D 11/00 112/420
1,611,462 A * 12/1926 Lambert ..... D01G 9/00 442/389
2,383,592 A * 8/1945 Davis ..... A47G 9/0207 5/502
2,816,054 A * 12/1957 Howden ..... B32B 27/00 428/198
3,081,517 A * 3/1963 Driesch ..... A41D 27/02 428/91

(Continued)

OTHER PUBLICATIONS

KR, Dar-midlife, Sally J, SkyLark53, et al.; Quilting Board; Using Flannel Instead of Batting, Jun. 5, 2014, https://www.quiltingboard.com/main-f1/using-flannel-instead-batting-t247962.html.*

(Continued)

*Primary Examiner* — Nicholas F Polito
*Assistant Examiner* — Morgan J McClure
(74) *Attorney, Agent, or Firm* — Hovey Williams LLP

(57) ABSTRACT

Improved batting insert materials for quilting are provided herein. The improved batting materials are adapted to be positioned between a quilt top and quilt bottom, and the materials advantageously prevent slippage of quilt layers during stitching without the need for pinning or basting. The insert materials generally comprise a batting layer and a flannel layer secured to the batting layer. The flannel layer is adapted to be positioned abutting the quilt bottom, and it has been discovered that the interaction between the surfaces of these fabrics prevents the layers from slipping. Quilts and methods utilizing the improved batting insert materials are also provided herein.

17 Claims, 2 Drawing Sheets

(56) References Cited

U.S. PATENT DOCUMENTS 3,242,508 A * 3/1966 Smithson ..... B68G 11/00 5/502
3,541,620 A * 11/1970 Chapuis ..... A47G 9/0207 5/413 R
3,801,420 A * 4/1974 Anderson ..... A47G 9/0207 428/102
4,583,247 A * 4/1986 Fingerhut ..... A41D 27/06 2/272
5,146,634 A * 9/1992 Hunt ..... A47G 9/0207 5/486
5,173,138 A * 12/1992 Blauch ..... B32B 5/12 156/177
5,398,355 A * 3/1995 Bailey ..... A47C 27/005 5/500
5,673,640 A * 10/1997 Duvall ..... A41D 27/02 112/420
6,101,645 A * 8/2000 Hill ..... A47G 9/0253 5/482
6,105,168 A * 8/2000 Hazen ..... A41B 13/06 2/69.5
7,188,756 B1 * 3/2007 Storm ..... D05B 91/04 223/101
7,886,378 B2 * 2/2011 Cheskis ..... B32B 3/06 112/419
2004/0187211 A1 * 9/2004 Wootten, Jr. ..... A47G 9/0207 5/497
2007/0243784 A1 * 10/2007 Shearrow ..... A47G 9/0284 442/320
2009/0100568 A1 * 4/2009 Judd ..... A61H 7/001 2/95
2011/0239369 A1 * 10/2011 Dobin ..... A47G 9/0207 5/502
2014/0134391 A1 * 5/2014 Lumb ..... B32B 7/08 428/102
2015/0082540 A1 * 3/2015 Sirok ..... A47G 9/0207 5/502
2016/0045043 A1 * 2/2016 Tisius ..... A47G 9/0284 5/502
2017/0354269 A1 * 12/2017 Burriss ..... A47C 27/22
2018/0274146 A1 * 9/2018 Aquino ..... D05B 39/005

OTHER PUBLICATIONS

Jasmine, Quilt Kisses, Double Batting Test, Mar. 28, 2016, http://quiltkisses.blogspot.com/2016/03/double-batting-test.html.*

* cited by examiner

QUILT BATTING MATERIALS AND METHODS OF USING THE SAME

BACKGROUND OF THE INVENTION

Field of the Invention

The present invention is generally directed to improved batting materials for quilting and methods of forming a quilt using the improved batting insert materials. The batting materials permit the quilter to dispense with the time-intensive step of pinning or basting the various quilt layers together during the quilting process.

Description of the Prior Art

Quilting is the process of sewing layers of fabric together to make a thicker padded quilt. Quilting generally involves assembling together three layers: the top fabric or quilt top, batting or insulating material, and backing or bottom material. The quilting process comprises hand or machine sewing to pass needle and thread through all layers and back up. This process is repeated across the entire area of the quilt. The quilter can use any number of desired stitching techniques and patterns during the quilting process.

During the stitching process, if appropriate care is not exercised, traditional batting materials may shift or slip between the top and bottom layers of the quilt thereby requiring constant re-adjusting and may result in a crooked quilt pattern. Quilters have tried a variety of techniques to reduce or prevent this slippage. For example, one technique is to hold one's hands over the top cover and apply pressure to the top layer, which attempts to hold the quilt layers together. However, this method is quite cumbersome and distracts the quilter from the stitching process, often resulting in mistakes. A more effective technique is attaching safety pins through the quilt layers at numerous locations to pin the layers in place. However, this technique generally requires the pins be placed every few inches apart, which can be quite time-consuming when making large quilts. Another technique is basting, which involves inserting temporary stitches through the quilt layers every few inches to hold the layers in place. Similar to the safety pin method, this method can be quite time-consuming. What is needed is an effective yet less time-consuming method to prevent slippage of these quilt layers during quilting.

SUMMARY OF THE INVENTION

In one embodiment of the present invention, there is provided a method of forming a quilt. The method comprises assembling an insert material between opposed top and bottom quilt covers. The insert material comprises a batting layer comprising a first surface and an opposed second surface, and a flannel layer secured to the first surface of the batting layer. The flannel layer abuts the bottom cover, and the second surface of the batting layer abuts the top cover.

In another embodiment, there is provided a quilt comprising a top cover, a bottom cover, and an insert material between the top cover and the bottom cover. The insert material comprises a batting layer comprising a first surface and an opposed second surface, and a flannel layer secured to the first surface of the batting layer. The flannel layer is positioned abutting the bottom cover, and the second surface of the batting layer is positioned abutting the top cover.

In yet another embodiment, there is provided an insert material adapted to be positioned between a top cover and a bottom cover of a quilt. The insert material comprises a batting layer comprising a first surface and an opposed second surface, and a flannel layer secured to the first surface of the batting layer. The flannel layer is adapted to be positioned abutting the bottom cover, and the second surface of the batting layer adapted to be positioned abutting the top cover.

DETAILED DESCRIPTION OF THE PREFERRED EMBODIMENT

Figure 1:
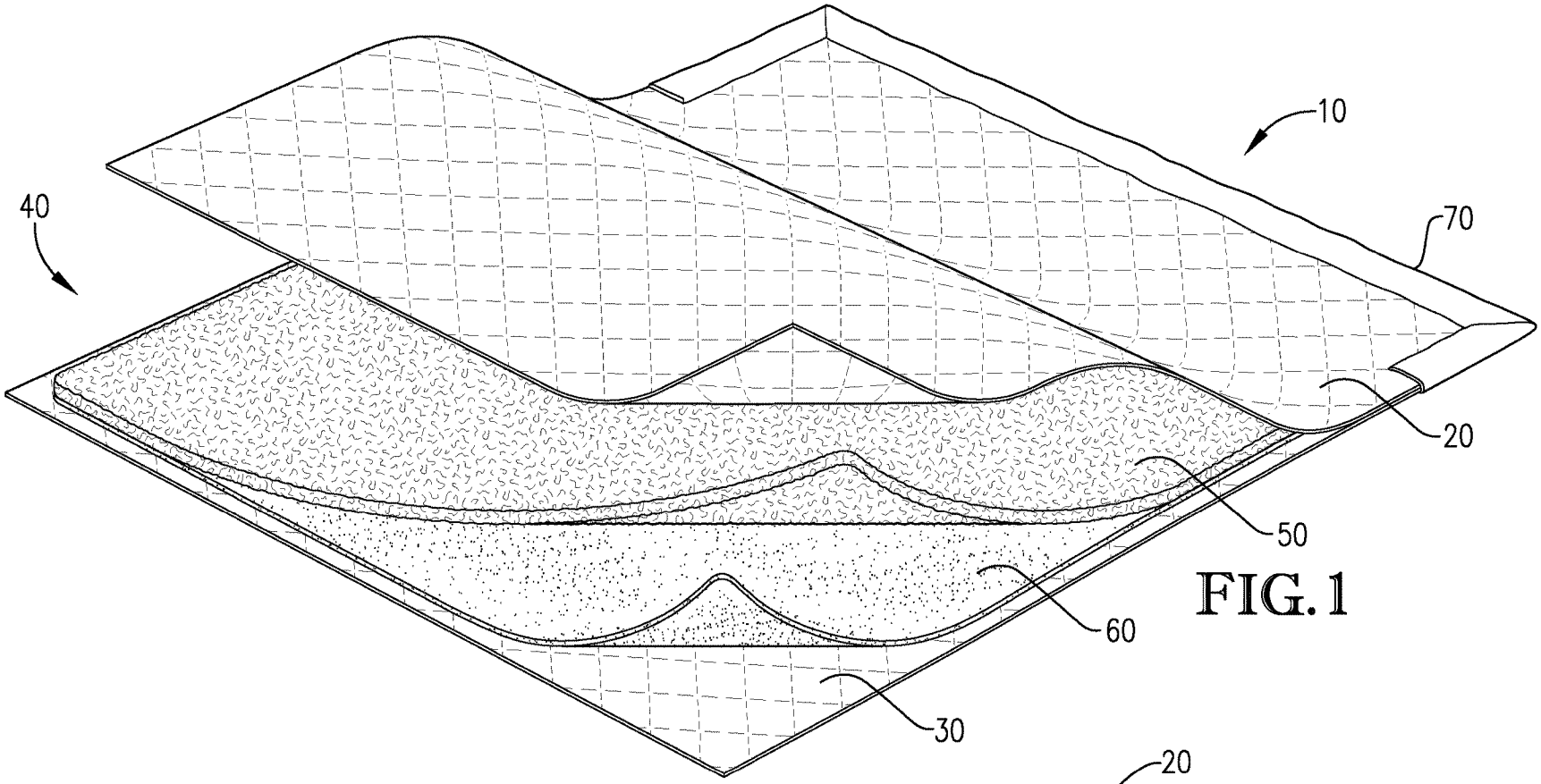
FIG. 1 is a cutaway perspective view of a quilt in accordance with one embodiment of the present invention.

Turning to FIG. 1, a quilt 10 is shown in accordance with one embodiment of the present invention. Quilt 10 comprises, consists of, or consists essentially of top cover 20, bottom cover 30, and insert material 40 positioned between top cover 20 and bottom cover 30. Insert material 40 generally comprises, consists of, or consists essentially of batting layer 50 and flannel layer 60. In some embodiments, insert material 40 or quilt 10 may comprise additional layers (not shown), for example, to impart a desired rigidity or texture. In certain embodiments, quilt 10 further comprises binding 70 positioned around the perimeter of quilt 10 and covering the outer edges of top cover 20, bottom cover 30, and insert material 40.

Top cover 20 is the aesthetic upper layer of the quilt and can be any of a number of designs or materials known in the art. In one or more embodiments, top cover 20 is a "pieced" (or "patchwork") layer comprising a number of smaller pieces sewn together, an appliqué layer comprising fabric design sewn over a background fabric, or a combination thereof. Top cover 20 may comprise a variety of materials or combination of materials to impart a particular aesthetic design. Additionally, top cover 20 may comprise a single layer of fabric or multiple layers. In certain embodiments, top cover 20 comprises a material selected from the group consisting of cotton, cotton blends, flannel, silk, synthetic materials, and combinations thereof. In certain preferred embodiments, top cover 20 comprises a bottom surface 22 comprising cotton or a cotton blend. In particularly preferred embodiments, top cover 20 comprises a bottom surface 22 comprising a woven fabric. As used herein, the term "woven fabric" means a fabric made by interlacing two or more threads at right angles to one another, such as with a loom. However, in certain embodiments, a knitted fabric may be used, such as when top cover 20 comprises a patchwork of sentimental garment fabrics (e.g., a tee-shirt quilt). As used herein, the term "knitted fabric" means a fabric made with interlaced loops, which may be formed from a single thread.

Bottom cover 30 is the lower layer (or "backing") of the quilt and provides a base upon which the additional quilt layers can be stacked during the quilting process. Bottom cover 30 may comprise a variety of materials and may comprise the same or different material(s) as top cover 20. The particular fabric used may be chosen based on a desired aesthetic design, a desired fabric texture, or other criteria. In certain embodiments, bottom cover 30 comprises a material selected from the group consisting of cotton, cotton blends, flannel, silk, synthetic materials, and combinations thereof. In certain preferred embodiments, bottom cover 30 comprises an upper surface 32 comprising cotton or a cotton blend. In particularly preferred embodiments, bottom cover 30 comprises an upper surface 32 comprising a woven fabric. However, in certain other embodiments, bottom cover 30 may comprise an upper surface 32 comprising a knitted fabric. Bottom cover 30 may comprise a single piece of fabric or two or more pieces of the same or different fabric sewn together.

Figure 2:
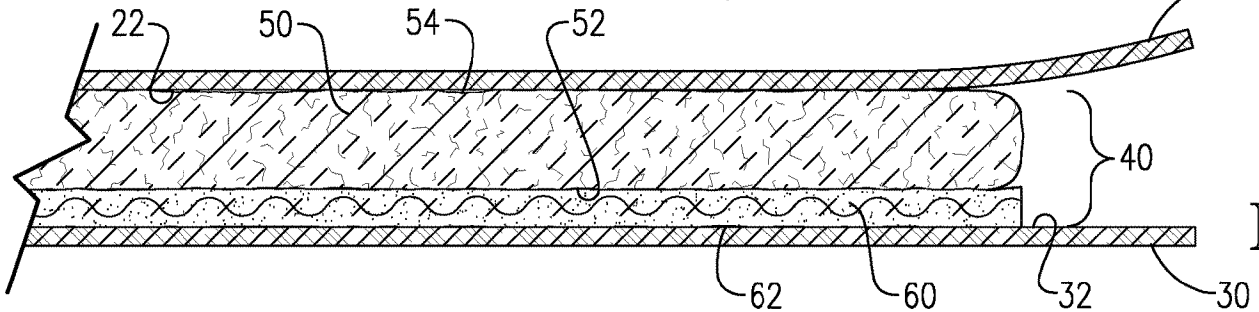
FIG. 2 is a cross-section view of the quilt of FIG. 1.
Figure 3:
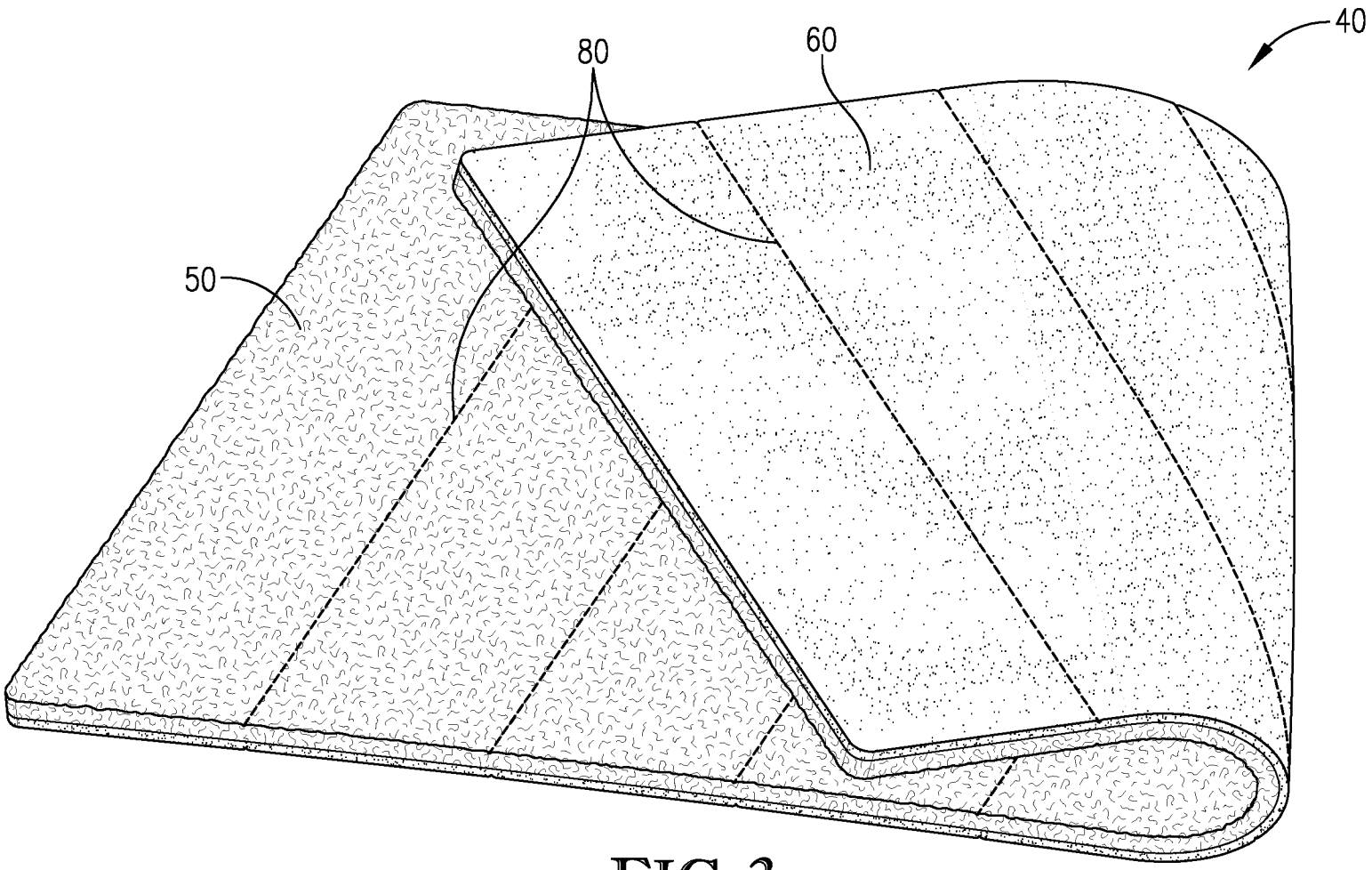
FIG. 3 is a perspective view of an insert material in accordance with one embodiment of the present invention.

Insert material 40 is adapted to be positioned between top cover 20 and bottom cover 30 of quilt 10. In accordance with embodiments of the present invention, insert material 40 comprises batting layer 50 and flannel layer 60. As best shown in FIG. 2, batting layer 50 generally comprises a first surface 52 and opposed second surface 54, with first surface 52 abutting flannel layer 60 and second surface 54 abutting top cover 20. In certain embodiments, flannel layer 60 is secured to first surface 52 of batting layer 50 to provide insert material 40 as a single piece adapted to be assembled between top cover 20 and bottom cover 30. Flannel layer 60 may be secured to batting layer 50 by a variety of methods. For example, in certain embodiments, flannel layer 60 is secured to first surface 52 of batting layer 50 by sewing the layers together with thread stitches or seams 80, as shown in FIG. 3. In certain such embodiments, flannel layer 60 is secured to first surface 52 of batting layer 50 by one or more thread stitches or seams 80 without being secured to top cover 20 or bottom cover 30 to provide a separate insert material product 40. That is, thread stitches or seams 80 only connect together batting layer 50 and flannel layer 60, and any additional layers (not shown) only present in insert material 40. The thread stitches or seams 80 may comprise various stitch types or patterns that are preferably different from a stitching design employed in the actual quilting process. In certain embodiments, the thread stitching or seams 80 comprise stitches selected from the group consisting of straight stitch, zigzag stitch, running stitch, back stitch, satin stitch, outline stitch, blind stitch, and combinations thereof. In certain preferred embodiments, the thread stitches or seams 80 comprise a blind stitch, which may provide for an inconspicuous connection of the batting layer 50 and flannel layer 60. Regardless the stitch type, the thread stitches or seams 80 will generally start at one edge or corner of the batting layer 50 and extend lengthwise to the opposite edge or corner. In certain embodiments, insert material 40 comprises two or more thread stitches or seams 80 spaced about 2 inches to about 18 inches apart, preferably about 4 inches to about 12 inches apart, and more preferably about 6 inches to about 8 inches apart. In certain other embodiments, flannel layer 60 is secured to first surface 52 of batting layer 50 by an adhesive, such as a suitable fabric adhesive tape, spray, or glue.

Batting layer 50 may comprise any of a number of materials known in the art as "batting." The batting material is generally chosen depending on the thickness and level of insulation desired for the quilt. The relative thickness of batting is referred to as the "loft." In certain embodiments, batting layer 50 comprises a low loft material. In certain such embodiments, batting layer 50 has an average thickness of less than about ½ inch. In certain embodiments, batting layer 50 has an average thickness of about 1/16 inch to about ½ inch, preferably about ⅛ inch to about ¼ inch. In particularly preferred embodiments, batting layer 50 has an average thickness of about ⅛ inch. Batting layer 50 can comprise a variety of batting materials known in the art. In certain embodiments, batting layer 50 comprises a material selected from the group consisting of cotton, cotton/polyester blends, wool and wool blends, silk, flannel, polyester, fusible materials, bamboo and bamboo blends, and mixtures thereof. In certain preferred embodiments, batting layer 50 comprises cotton or a cotton blend. In certain preferred embodiments, batting layer 50 comprises a nonwoven fabric. As used herein, the term "nonwoven fabric" means a fabric that is neither woven nor knitted, and comprises sheet or web structures bonded together by entangling fiber or filaments (and by perforating films) mechanically, thermally, or chemically.

Flannel layer 60 generally comprises a sheet of flannel fabric material secured to batting layer 50. Flannel is a woven fabric and may be produced from wool, cotton, synthetic fiber, or other material, with one or both surfaces of the fabric generally having a "napped" texture. The napped texture may be formed by any of a variety of techniques known in the art. For example, one or both surfaces may be brushed with a fine metal brush to rub the fabric and raise fine fibers from the loosely spun woven fabric. Thus, in certain embodiments, flannel layer 60 comprises at least one napped surface 62. However, in certain other embodiments, surface 62 is not napped. Regardless the embodiment, surface 62 is adapted to abut bottom cover 30 during assembly of quilt 10. Surface 62 of flannel layer 60 is configured to interact with bottom cover 30 to prevent relative motion between bottom cover 30 and insert material 40 during stitching together of quilt 10. This overcomes the problem of slippage between batting and quilt backing without the need for time-consuming pinning or basting. Without being bound by any theory, it is believed the woven fabric of flannel layer 60 provides sufficient friction with the fabric of bottom cover 30 to prevent the fabrics of these layers from sliding against each other despite the shear force applied to the layers during stitching. In certain preferred embodiments, flannel layer 60 comprises a pre-washed flannel fabric. Binding 70 generally comprises one or more layers of fabric sewn around the perimeter edge of quilt 10 and is configured to cover the raw fabric edges of the various layers and to help hold the layers together. Binding 70 may comprise a variety of materials and may comprise the same or different material(s) as top cover 20 and/or bottom cover 30. Although binding 70 serves the functional purposes described above, the material, size, and design of the fabric will generally be chosen based on aesthetics.

Embodiments of the present invention further comprise a method of forming quilt 10. The method comprises assembling insert material 40 between top cover 20 and opposed bottom cover 30. The assembling generally comprises stacking bottom cover 30, insert material 40, and top cover 20 such that first surface 52 of batting layer 50 abuts flannel layer 60, second surface 54 of batting layer 50 abuts top cover 20, and surface 62 of flannel layer 60 abuts bottom cover 30. In certain preferred embodiments, flannel layer 60 is secured to first surface 52 of batting layer 50 before the assembling step. In certain such embodiments, flannel layer 60 is secured to batting layer 50 by a stitching step (i.e., hand or machine stitching). In certain embodiments, the method comprises pre-washing flannel layer 60 before securing flannel layer 60 to batting layer 50. This step ensures flannel layer 60 will not shrink in size compared to the other layers during washing of the finished quilt 10. Once the layers are assembled, certain embodiments of the inventive method further comprise stitching together top cover 20, bottom cover 30, and insert material 40 without pinning or basting insert material 40 to either top cover 20 or bottom cover 30. Advantageously, the use of flannel layer 60 allows for stitching together these layers without substantial sliding of bottom cover 30 relative to insert material 40.

The invention claimed is:

1. A method of forming a quilt comprising:

assembling an insert material between opposed top and bottom quilt covers, the insert material comprising a batting layer comprising a first surface and an opposed second surface, and a flannel layer secured to the first surface of the batting layer, the flannel layer abutting the bottom cover, and the second surface of the batting layer abutting the top cover; and stitching together the top quilt cover, the bottom quilt cover, and the insert material without pinning or basting the insert material to either the top cover or the bottom cover and without substantial sliding of the bottom quilt cover relative to the insert material.

2. The method of claim 1, wherein the flannel layer is secured to the first surface of the batting layer before the assembling step.

3. The method of claim 2, wherein the flannel layer is secured to the first surface of the batting layer by stitching.

4. The method of claim 3, wherein the flannel layer is secured to the first surface of the batting layer by two or more substantially parallel stitches spaced about 2 inches to about 18 inches apart.

5. The method of claim 2, wherein the flannel layer is secured to the first surface of the batting layer by an adhesive.

6. The method of claim 2, wherein the flannel layer is pre-washed before being secured to the first surface of the batting layer.

7. A quilt comprising:

a top cover;

a bottom cover; and an insert material between the top cover and the bottom cover, the insert material comprising a batting layer comprising a first surface and an opposed second surface, and a flannel layer secured to the first surface of the batting layer, wherein the flannel layer is configured to prevent relative motion between the bottom cover and insert material during stitching together of the quilt without pinning or basting the insert material to either the top cover or the bottom cover and positioned abutting the bottom cover, and the second surface of the batting layer is positioned abutting the top cover.

8. The quilt of claim 7, wherein the batting layer comprises a nonwoven fabric.

9. The quilt of claim 7, wherein the batting layer comprises a low loft batting material.

10. The quilt of claim 7, wherein the bottom cover comprises a woven or knitted fabric.

11. The quilt of claim 7, wherein the top and bottom covers comprise a material selected from the group consisting of cotton, cotton blends, flannel, silk, synthetic materials, and combinations thereof.

12. An insert material adapted to be positioned between a top cover and a bottom cover of a quilt, the insert material comprising:

a batting layer comprising a first surface and an opposed second surface, and a flannel layer secured to the first surface of the batting layer, wherein the flannel layer is configured to prevent relative motion between the bottom cover and insert material during stitching together of the quilt without pinning or basting the insert material to either the top cover or the bottom cover and adapted to be positioned abutting the bottom cover, and the second surface of the batting layer adapted to be positioned abutting the top cover.

13. The insert material of claim 12, wherein the batting layer comprises a material selected from the group consisting of cotton, cotton/polyester blends, wool and wool blends, silk, flannel, polyester, fusible materials, bamboo and bamboo blends, and mixtures thereof.

14. The insert material of claim 12, wherein the batting layer comprises a nonwoven fabric.

15. The insert material of claim 12, wherein the batting layer comprises a low loft batting material.

16. The insert material of claim 12, wherein the flannel layer comprises pre-washed flannel material.

17. The insert material of claim 12, wherein the flannel layer is secured to the first surface of the batting layer by two or more substantially parallel stitches spaced about 2 inches to about 18 inches apart.

* * * * *